US008905630B2

(12) United States Patent
Helfer et al.

(10) Patent No.: US 8,905,630 B2
(45) Date of Patent: Dec. 9, 2014

(54) TIMEPIECE WITH COUPLED OSCILLATORS IN CHRONOGRAPH MODE

(75) Inventors: Jean-Luc Helfer, Bienne (CH); Thierry Hessler, St-Aubin (CH); Thierry Conus, Lengnau (CH)

(73) Assignee: The Swatch Group Research and Development Ltd., Marin (CH)

( * ) Notice: Subject to any disclaimer, the term of this patent is extended or adjusted under 35 U.S.C. 154(b) by 164 days.

(21) Appl. No.: 13/609,786

(22) Filed: Sep. 11, 2012

(65) Prior Publication Data

US 2013/0070568 A1 Mar. 21, 2013

(30) Foreign Application Priority Data

Sep. 15, 2011 (EP) ..... 11181505

(51) Int. Cl.
*G04B 17/00* (2006.01)
*G04B 17/26* (2006.01)
*G04F 7/08* (2006.01)

(52) U.S. Cl.
CPC . *G04F 7/08* (2013.01); *G04B 17/26* (2013.01)
USPC ..... 368/101; 368/127; 368/169

(58) Field of Classification Search
USPC ..... 368/97, 101, 124, 127, 140, 169, 168
See application file for complete search history.

(56) References Cited

U.S. PATENT DOCUMENTS

| | | | | |
|---|---|---|---|---|
| 6,406,176 | B1 * | 6/2002 | Takahashi et al. | 368/101 |
| 7,527,423 | B2 * | 5/2009 | Ruchonnet et al. | 368/127 |
| 2006/0221775 | A1 * | 10/2006 | Zaugg | 368/127 |
| 2010/0002548 | A1 | 1/2010 | Hessler et al. | |
| 2010/0214879 | A1 | 8/2010 | Lechot et al. | |
| 2011/0096636 | A1 * | 4/2011 | Pellet | 368/127 |
| 2011/0164474 | A1 * | 7/2011 | Jolidon | 368/66 |

FOREIGN PATENT DOCUMENTS

| | | |
|---|---|---|
| EP | 2 141 555 A1 | 1/2010 |
| EP | 2 221 676 A1 | 8/2010 |

OTHER PUBLICATIONS

U.S. Appl. No. 13/609,943, filed Sep. 11, 2012, Helfer, et al.
U.S. Appl. No. 13/610,024, filed Sep. 11, 2012, Sarchi, et al.
European Search Report issued Apr. 26, 2012 in corresponding European Application No. 11 18 1505 filed on Sep. 15, 2011 (with an English Translation).

* cited by examiner

*Primary Examiner* — Amy Cohen Johnson
*Assistant Examiner* — Matthew Powell
(74) *Attorney, Agent, or Firm* — Oblon, Spivak, McClelland, Maier & Neustadt, L.L.P.

(57) ABSTRACT

A timepiece includes a first oscillator oscillating at a first frequency and connected by a first gear train to an energy source to display the time. The timepiece also includes a chronograph system including a second gear train connected to the first gear train via a coupling device for selectively measuring a time. The chronograph system further includes a second oscillator, which is connected to the second gear train and oscillates at a second frequency. Moreover, the second gear train is connected to the first gear train by an elastic coupling, in order to synchronize the rate of the two oscillators using the same energy source when the coupling device is in a coupled position.

14 Claims, 3 Drawing Sheets

TIMEPIECE WITH COUPLED OSCILLATORS IN CHRONOGRAPH MODE

This application claims priority from European Patent Application No. 11181505.6 filed Sep. 15, 2011, the entire disclosure of which is incorporated herein by reference.

FIELD OF THE INVENTION

The invention relates to a timepiece with coupled oscillators in chronograph mode and a timepiece of this type comprising two oscillators intended to display at least one value less than or equal to a second with better resolution and/or better precision.

BACKGROUND OF THE INVENTION

It is known to form timepieces with increased frequency in order to improve resolution. However, these timepieces may be very shock sensitive or high energy consumers, which prevents them from becoming common.

It is therefore clear that it is easier to manufacture a calibre by mounting a low frequency oscillator, typically 4 Hz, to display the time and another high frequency oscillator, typically 10 or 50 Hz, which is independent from the first, to display a measured time with improved resolution. However, after several seconds, it is observed that the seconds display of the two oscillators is no longer the same, which may make the quality of the timepiece appear dubious.

SUMMARY OF THE INVENTION

It is an object of the present invention to overcome all or part of the aforementioned drawbacks by proposing a timepiece capable of displaying the time or measured time with a chronograph system with better resolution, while ensuring the usual robustness of a mechanical watch, reduced energy consumption and minimum drift between the time display and the measured time display, even if the measured time is greater than a minute.

The invention therefore relates to a timepiece comprising a first oscillator oscillating at a first frequency and connected by a first gear train to an energy source to display the time, and a chronograph system comprising a second gear train connected to the first gear train via a coupling device for selectively measuring a time, characterized in that the chronograph system further comprises a second oscillator which is connected to the second gear train and oscillates at a second frequency, and in that the second gear train is connected to the first gear train by an elastic coupling means in order to synchronise the rate of the two oscillators using the same energy source when the coupling device authorises said time measurement.

It is therefore clear that, even in the event of shocks, rate variations will be minimal owing to the construction which allows the two oscillators to be synchronised. Consequently, the timepiece according to the invention is capable of displaying the time and/or the measured time with a chronograph system with better resolution and/or better precision while ensuring a high level of robustness, low power consumption and minimal drift between the time display and the measured time display, even if the measured time is greater than a minute.

In accordance with other advantageous features of the invention:

- the elastic coupling means is formed by a spring connecting one wheel of the first gear train to another wheel of the second gear train;
- the elastic coupling means connects the fourth wheels respectively of the first gear train and the second gear train;
- the first oscillator receives the most torque from the energy source and, preferably, at least 75% of the torque;
- the first oscillator has better quality isochronism than the second oscillator so as to facilitate synchronisation of said second oscillator;
- the first oscillator has a higher quality factor than the second oscillator;
- the second oscillator has a quality factor of less than 100 so as to obtain more rapid stabilisation;
- according to a first embodiment, the first and second frequencies are identical;
- the two frequencies are higher than 5 Hz for displaying both the time and the measured time with better resolution and/or better precision;
- according to a second embodiment, the first frequency is higher than the second frequency so as to display the time with better resolution and/or better precision;
- the first frequency is at least equal to 10 Hz and the second frequency is between 1 and 5 Hz;
- according to a third embodiment, the first frequency is lower than the second frequency so as to display the measured time with better resolution and/or better precision;
- the second frequency is at least equal to 10 Hz and the first frequency is between 3 and 5 Hz.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
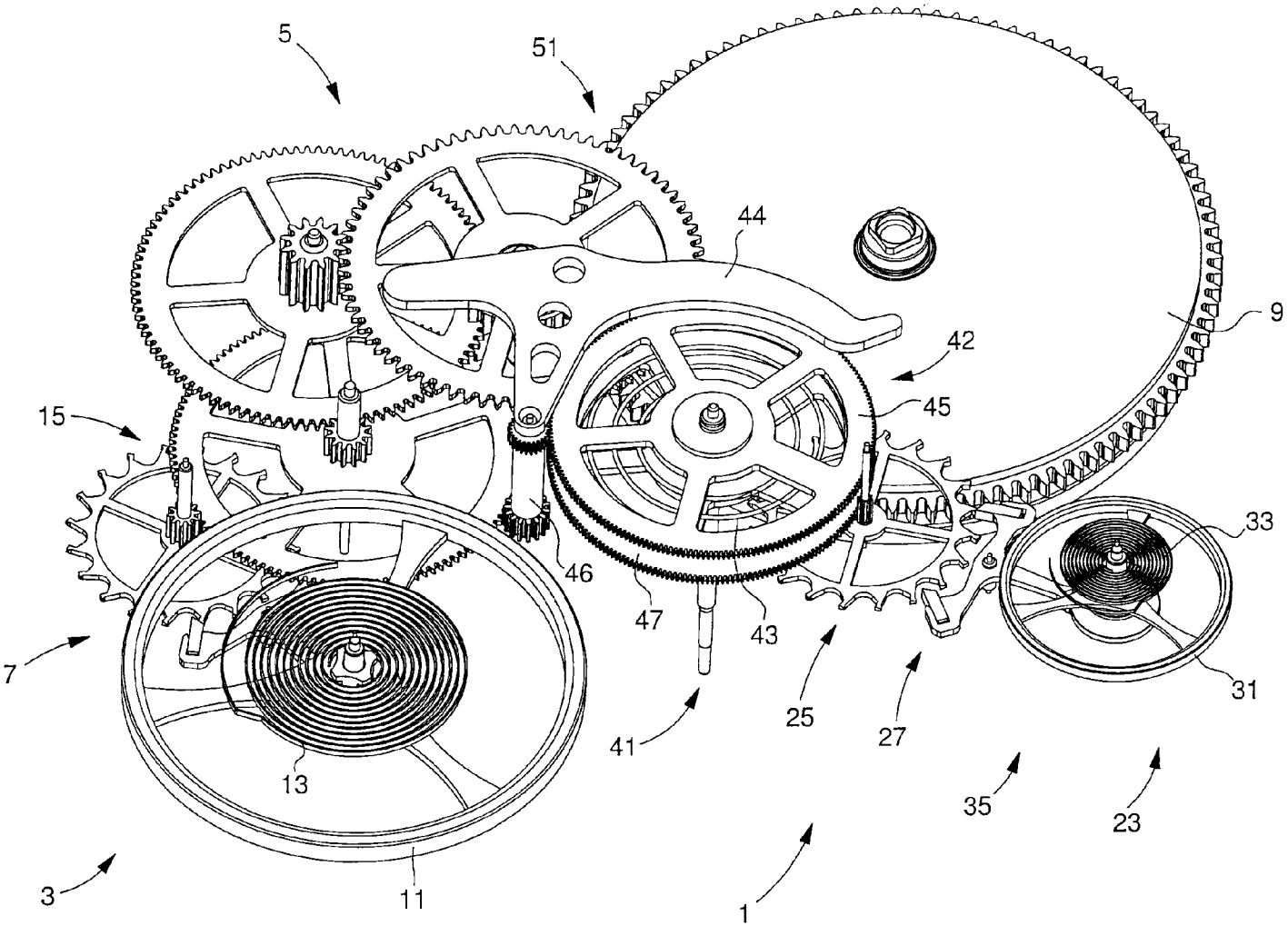
FIG. 1 is an example of a timepiece according to the invention.
Figure 2:
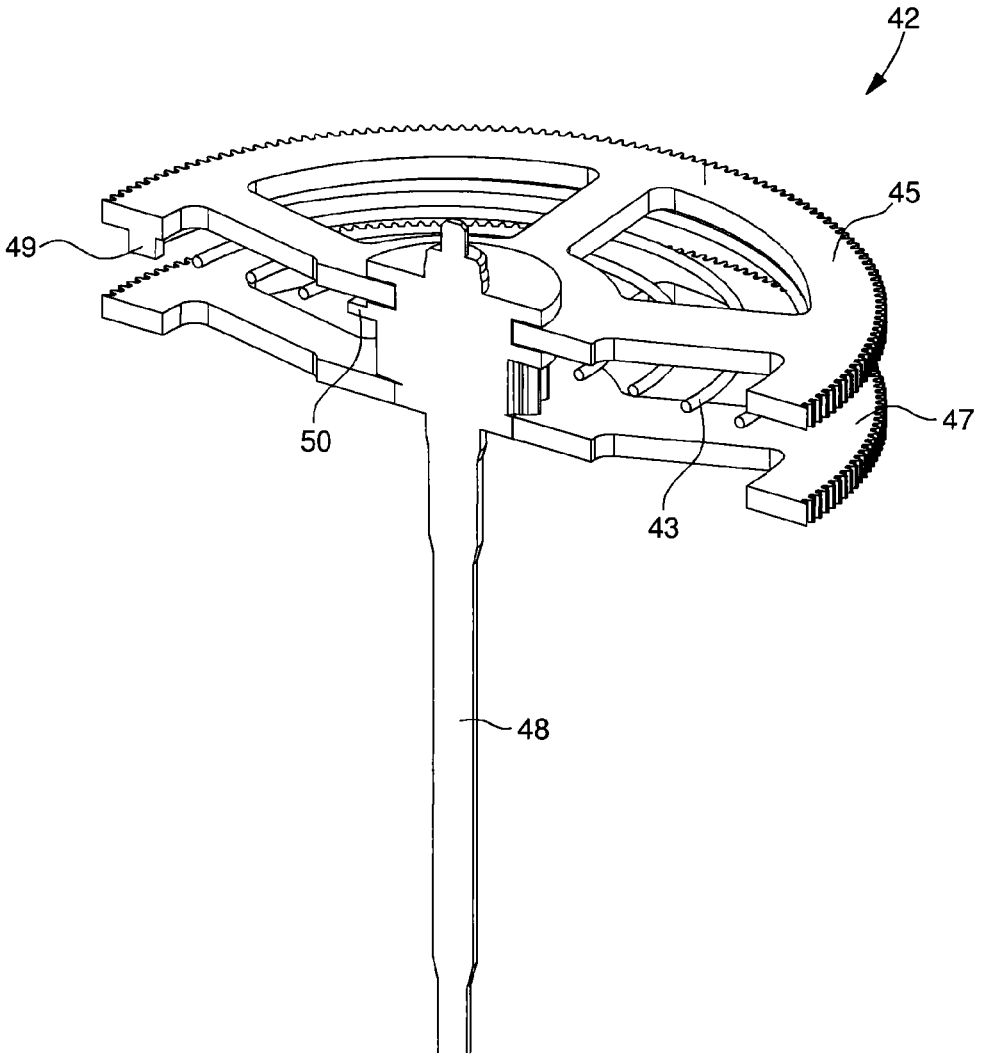
FIG. 2 is an example of elastic coupling means according to the invention.

As illustrated in FIGS. 1 and 2, the invention relates to a timepiece 1 including a first resonator 3 and connected by a first gear train 5 via a first escapement 7 to an energy source 9. The first resonator 3 and the first escapement 7 thus form a first oscillator 15 oscillating at a first frequency $f_1$ to display the time. Timepiece 1 also includes a chronograph system 51 comprising a second gear train 25 connected to the first gear train 5 via a coupling device 44 for selectively measuring a time.

Advantageously according to the invention, chronograph system 51 further includes a second oscillator 35 which is connected to second gear train 25 and oscillates at a second frequency $f_2$. Further, according to the invention, the second gear train 25 is advantageously connected to first gear train 5 by an elastic coupling means 41 in order to synchronise the rate of the two oscillators 15, 35, using the same energy source 9, when coupling device 44 authorises said time measurement.

As seen in the example of FIG. 1, energy source 9 is preferably a barrel, i.e. a source of mechanical energy accumulation. Moreover, in the same Figure, second oscillator 35 comprises a second oscillator 23 connected to second gear train 25 via a second escapement 27.

Preferably according to the invention, elastic coupling means 41 is formed by a spring 43 connecting one wheel of first gear train 5 to another wheel of second gear train 25. As illustrated in FIG. 2, preferably according to the invention, the elastic coupling means 41 connects the fourth wheels respectively of first gear train 5 and second gear train 25 when coupling device 44 is in its coupled position, i.e. it authorises total transmission of the torque it receives.

Preferably according to the invention, it is seen that a double wheel 42 is used. As shown more clearly in FIG. 2, it is formed by a first plate 45 connected via an intermediate wheel 46 of coupling device 44 to first gear train 5. The double wheel 42 further includes a one second plate 47 directly or indirectly connected to second gear train 25 of chronograph system 51. The two plates 45, 47 are respectively loosely and fixedly secured to an arbour 48. Finally, spring 43 of elastic coupling means 41 is preferably mounted between the fastener 49 secured to the felloe of plate 45 and the collar 50 of arbour 48. It is thus clear that plates 45 and 47 and incidentally, gear trains 5 and 25, can be angularly shifted by the elastic coupling of spring 43 when coupling device 44 is in its coupled position.

Preferably according to the invention, the time display, i.e. the hours, minutes and possibly seconds, can be achieved using first gear train 5. Whereas the display of the time measured by chronograph system 51 is preferably achieved using second gear train 25.

Depending upon the desired application of the timepiece, the first $f_1$ and second $f_2$ frequencies may or may not be identical. Thus, in a first embodiment, the first and second frequencies $f_1$, $f_2$ are identical and preferably higher than 5 Hz so as to display both the time and the measured time with better resolution and/or better precision. In this embodiment, frequencies $f_1$, $f_2$ may, for example, be equal to 10 Hz or 50 Hz for displaying 1/20th or 1/100th of a second respectively.

In a second embodiment, the first frequency $f_1$ is higher than the second frequency $f_2$ so as to display the time with better resolution and/or better precision. In a similar manner to the first embodiment, the first frequency $f_1$ is at least equal to 10 Hz and the second frequency $f_2$ is preferably comprised between 1 and 5 Hz. Indeed, by way of example, it may be desired for the measured time seconds to be incremented by a single step per second, i.e. second frequency $f_2$ is equal to 1 Hz, "like" a quartz watch.

In a third embodiment, the first frequency $f_1$ is lower than the second frequency $f_2$ so as to display the time with better resolution and/or better precision. In this embodiment, which is the reverse of the second embodiment, the second frequency $f_2$ is at least equal to 10 Hz and the first frequency $f_1$ is preferably comprised between 3 and 5 Hz.

Simulations were developed hereinafter to describe the synchronisation between these two oscillators 15 and 35. The third embodiment has been arbitrarily selected for the explanation. Thus, oscillator 15 is selected to be a low frequency oscillator and is called the first oscillator. Consequently, in the example below, the second oscillator will be high frequency oscillator 35, which will be synchronised with low frequency oscillator 15.

Preferably according to the invention, the second oscillator 35 is selected with a strong anisochronism according to amplitude, described by the anisochronism slope Γ, and the amplitude $A^0_2$ at which the rate is zero. Moreover, it is assumed that first oscillator 15 always has a substantially zero rate by slightly varying its amplitude.

The simulations show the change in the two oscillators 15, 35, i.e. their amplitude and state of phase difference with time, and thus mean that it can be checked whether or not it is possible to synchronise second oscillator 35 with first oscillator 15.

Preferably, second oscillator 35 is constructed so that its rate is zero when it oscillates at amplitude $A^0_2$, positive when it oscillates at an amplitude higher than $A^0_2$ and negative when it oscillates at an amplitude lower than $A^0_2$.

Further, elastic coupling means 41 is devised so that the torque transmitted to second gear train 25 remains constant if the two gear trains 5, 25 are rotating at the same speed, decreases if second gear train 25 is advancing more quickly than first gear train 5 (spring 43 is letting down) and increases if second gear train 25 is advancing more quickly than first gear train 5 (spring 43 is being wound).

If the above conditions are satisfied, the timepiece will always move towards the stable situation where second oscillator 35 oscillates at amplitude $A^0_2$ and in which spring 43 transmits to second gear train 25 the torque $M_2$ necessary to keep second oscillator 35 at amplitude $A^0_2$.

Consequently, if second oscillator 35 receives a torque lower than $M_2$, its amplitude decreases, i.e. it has an amplitude of less than $A^0_2$. As explained above, its rate becomes negative, i.e. second oscillator 35 falls behind first oscillator 15.

It is thus clear that second gear train 25 will rotate more slowly than first gear train 5 while winding coupling spring 43, i.e. increasing the torque transmitted to second gear train 25. Consequently, since the torque is increasing, the amplitude of second oscillator 35 is automatically corrected. It is thus observed that the torque and amplitude of second oscillator 35 are structurally synchronised on stable torque $M_2$ and stable amplitude $A^0_2$.

Similarly, if the torque received exceeds torque $M_2$, then the amplitude of second oscillator 35 becomes greater than value $A^0_2$, which means that the rate of second oscillator 35 will be positive. Second gear train 25 is then ahead of first gear train 5 while letting down spring 43. Consequently, the torque on second gear train 25 will decrease towards stable torque $M_2$ and the amplitude of second oscillator 35 will again tend towards stable amplitude $A^0_2$.

It is thus seen that, regardless of the situation, whether it is when the watch is started, or after a shock, the system will always move towards stabilisation in the stable situation where the torque on second gear train 25 has a value $M_2$ and the amplitude of second oscillator 35 has a value of $A^0_2$.

Preferably according to the invention, it is assumed that barrel torque 9 and the frequency $f_1$, $f_2$ of the two oscillators 15, 35 are given parameters. It is thus clear that the parameters still to be selected are:

- the "size" of the two oscillators 15, 35 (for example inertia blocks $I_1$, $I_2$ if resonators 3, 23 are of the sprung balance type);
- the quality factors of the two oscillators 15, 35: $Q_1$, $Q_2$ (which is a function of the size of the oscillator);
- the anisochronism slope of the second oscillator: Γ;
- the amplitude of the second oscillator at which its rate is zero: $A^0_2$;
- the torque $M_2$ of spring 43;
- the angular rigidity K of spring 43.

Preferably according to the invention, the parameters are selected as follows:

- a fraction of the total torque desired to be transmitted to the second oscillator, which gives the torque value $M_2$. According to the invention, the first oscillator 15 receives the most torque via energy source 9 and preferably at least 75% thereof;

the amplitude $A^0_2$ at which the second oscillator is required to stabilise (therefore the second oscillator must be devised so that its rate is substantially zero at this amplitude);

the size of the second oscillator (for example the inertia block) so that the stabilising amplitude is $A^0_2$ when it receives torque $M_2$ (via the quality factor);

the size of the first oscillator (for example the inertia block) so that the stabilising amplitude is acceptable (via the quality factor);

anisochronism slope r of the second oscillator 35;

rigidity K of spring 43.

Advantageously according to the invention, it is also preferred to "adjust" K and Γ so that:

the torque transmitted to gear train 25 never becomes zero;

the rate of second oscillator 35 remains close to its zero frequency;

the drift in state between the two oscillators 15, 35 is small at the "start up";

the stabilising time is sufficiently short.

Empirically, it was demonstrated that it is preferable for the product K·Γ to be kept identical in order to have the same stabilisation time in the continuing approximation. Thus, increasing K (and thus decreasing Γ by the same amount) decreases the fluctuations in amplitude and torque (thus preventing the torque being cancelled out). However, this also increases the maximum state drift prior to stabilisation, and the instantaneous rate, which may become extreme. A compromise must therefore be found between these two effects.

It was also observed that increasing the frequency of the oscillator which is synchronised (second oscillator 35 above) decreases the stabilisation time. Finally, during tests, it was demonstrated that decreasing the quality factor of the oscillator which is synchronised (the second oscillator above) also decreases the stabilisation time.

Figure 3:
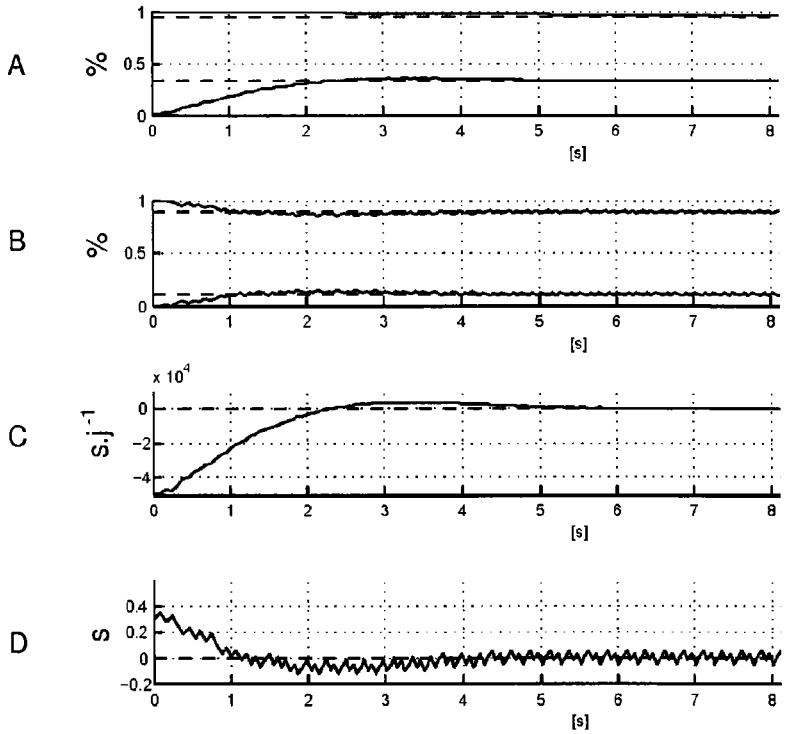
FIGS. 3 and 4 are synchronisation simulations for two example timepieces according to the invention.
Figure 4:
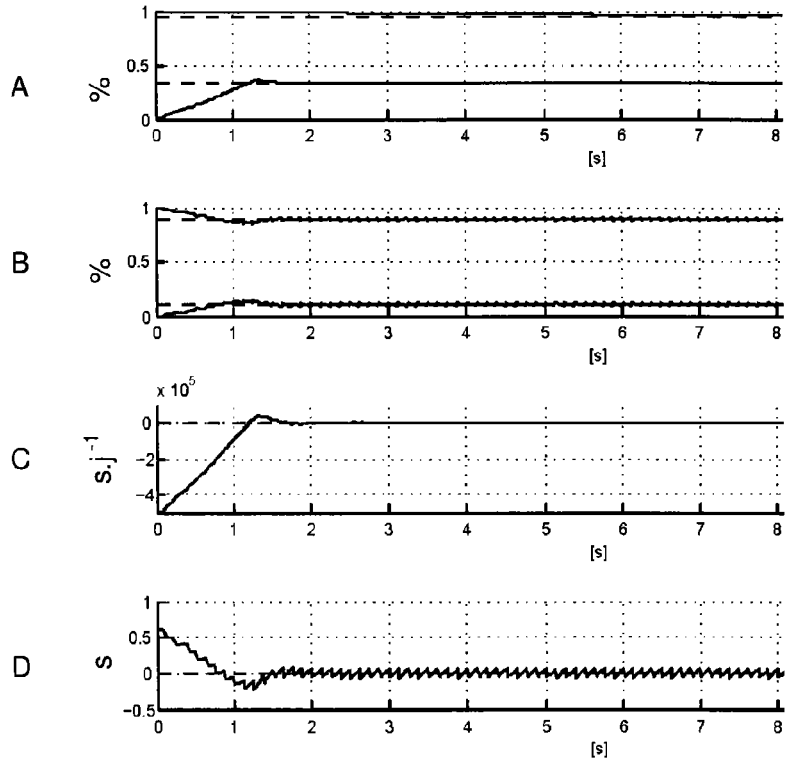

FIGS. 3 and 4 show simulations carried out by way of example implementation. In FIG. 3, $f_1$=4 Hz, $f_2$=10 Hz, $Q_1$=200, $Q_2$=50 and, in FIG. 4, $f_1$=4 Hz, $f_2$=50 Hz, $Q_1$=200, $Q_2$=50 with an identical product K·Γ for each simulation.

Part A of each Figure corresponds to the fraction of amplitude of each oscillator relative to the reference amplitude if it received all of the torque from the energy source. It is to be noted that for the examples in the Figures, the amplitude $A^0_2$ chosen for the second oscillator is approximately ⅓. Thus, after 2 and 1.5 seconds respectively, each oscillator is stabilised at its synchronised amplitude.

Part B of each Figure corresponds to the fraction of torque that each oscillator receives from the energy source. It is to be noted that for the examples in the Figures, the proportion of torque chosen for the second oscillator is around 10%. Thus, after 2 and 1.5 seconds respectively, each oscillator receives its proportion of torque in a stabilised manner.

Part C of each Figure corresponds to the rate of the second oscillator. It is to be noted therefore that after 5.5 and 2 seconds respectively, the second oscillator is stabilised around its zero rate.

Finally, part D of each Figure corresponds to the difference in state in seconds between each oscillator. It is therefore to be noted that after 5 and 2 seconds respectively, the difference is stabilised at its zero value.

Parts A-D of FIGS. 3 and 4 therefore illustrate perfectly the conclusions set out above. It is therefore clear that, in the event of shocks, rate variations will be minimal owing to the construction which allows the two oscillators to be synchronised. Consequently, the timepiece according to the invention is capable of displaying the time and/or the measured time with a chronograph system with better resolution and/or better precision while ensuring a high level of robustness, low power consumption and minimal drift between the time display and the measured time display, even if the measured time is greater than a minute.

Moreover, during tests, it was discovered that not only did the first oscillator preferably have better quality isochronism than the second oscillator so as to facilitate synchronisation of said second oscillator, but the second oscillator preferably has a lower quality factor than the first oscillator, and preferably lower than 100, so as to obtain more rapid stabilisation, i.e. typically in less than 2 seconds.

Of course, this invention is not limited to the illustrated example but is capable of various variants and alterations that will appear to those skilled in the art. In particular, a second coupling mechanism may be mounted on the hour wheel of first gear train 5 to avoid adding a reduction gear to the second gear train 25 for displaying the hours of the measured time. It is thus clear that the second coupling mechanism would belong to coupling device 44 and would be released at the same time. Advantageously according to the invention, since both oscillators are synchronised, the hour display would also be incremented in a synchronised manner.

Moreover, the conclusions relating to the third embodiment are also valid for the first and second embodiments. Thus, in the reverse of the above example, if the first oscillator is a high frequency oscillator, the time display could be limited to the hours and minutes using first gear train 5 so as to limit the propagation of torque induced by any shock to the high frequency oscillator. A second would preferably only be displayed then on second gear train 25.

Further, when the first and/or second oscillator is a high frequency oscillator, i.e. higher than or equal to 5 Hz, a Clifford oscillator may be used (see for example CH Patent No. 386344 incorporated herein by reference). Whereas, when the frequency of the oscillators is comprised between 1 and 5 Hz, they will preferably be sprung balance oscillators with a Swiss lever escapement.

Of course, the elastic coupling means is not limited to a double wheel 42 cooperating with a spring 43, as illustrated in FIGS. 1 and 2. Other elastic coupling means may be envisaged, for example those disclosed in patent document PCT/EP2011/061244 which is incorporated herein by reference.

Finally, it is possible to further optimise the behaviour of the system if the anisochronism of the second oscillator is non-linear. By way of example, the second oscillator may have a low anisochronsim around the amplitude of equilibrium and a strong anisochronism far from the amplitude of equilibrium, or vice versa.

What is claimed is:

1. A timepiece, comprising:

a first oscillator comprising a first resonator and a first escapement, and the first oscillator oscillates at a first frequency and is connected by a first gear train to an energy source for displaying the time; and a chronograph system comprising a second gear train connected to the first gear train via a coupling device for selectively measuring a time, wherein the chronograph system further includes a second oscillator comprising a second resonator and a second escapement, and the second oscillator is connected to the second gear train and oscillates at a second frequency, and wherein the second gear train is connected to the first gear train by an elastic coupling means in order to synchronise the rate of the two oscillators using the same energy source when the coupling device is in a coupled position.

2. The timepiece according to claim 1, wherein the elastic coupling means is formed by a spring connecting one wheel of the first gear train to another wheel of the second gear train.

3. The timepiece according to claim 2, wherein the elastic coupling means connects the fourth wheels respectively of the first gear train and the second gear train.

4. The timepiece according to claim 1, wherein the first oscillator receives more torque from the energy source than the second oscillator.

5. The timepiece according to claim 4, wherein the first oscillator receives at least 75% of the torque supplied by the energy source.

6. The timepiece according to claim 1, wherein the first oscillator has a better isochronism than the second oscillator so to facilitate the synchronisation of said second oscillator.

7. The timepiece according to claim 1, wherein the first oscillator has a higher quality factor than the second oscillator.

8. The timepiece according to claim 7, wherein said second oscillator has a quality factor of less than 100 so as to obtain more rapid stabilisation.

9. The timepiece according to claim 1, wherein the first and second frequencies are identical.

10. The timepiece according to claim 9, wherein the two frequencies are higher than 5 Hz.

11. The timepiece according to claim 1, wherein the first frequency is higher than the second frequency.

12. The timepiece according to claim 11, wherein the first frequency is at least equal to 10 Hz and the second frequency is between 1 and 5 Hz.

13. The timepiece according to claim 1, wherein the first frequency is lower than the second frequency.

14. The timepiece according to claim 13, wherein the second frequency is at least equal to 10 Hz and the first frequency is between 3 and 5 Hz.

* * * * *